US005983569A

United States Patent [19]

Karlsson

[11] Patent Number: 5,983,569

[45] Date of Patent: Nov. 16, 1999

[54] TURNABLE WINDOW ARRANGEMENT

[75] Inventor: Arne Karlsson, Lysekil, Sweden

[73] Assignee: As Spilka International Ltd., Alesund, Norway

[21] Appl. No.: 09/037,314

[22] Filed: Mar. 9, 1998

[51] Int. Cl.[6] ..... E05F 11/36

[52] U.S. Cl. ..... 49/354; 49/394

[58] Field of Search ..... 49/246, 252–254, 49/258, 260, 354, 356, 407, 394; 403/370, 374.3, 374.4, 110

[56] References Cited

U.S. PATENT DOCUMENTS 4,860,811 8/1989 Flakk ..... 49/354 X
5,649,780 7/1997 Schall ..... 403/370 X
5,692,865 12/1997 Pratt ..... 403/370 X

*Primary Examiner*—Daniel P. Stodola
*Assistant Examiner*—Hugh B. Thompson
*Attorney, Agent, or Firm*—McAulay Nissen Goldberg Kiel & Hand

[57] ABSTRACT

A turnable window arrangement has a window sash to be rotated about a horizontal axis through approximately 180° relative to a window frame. The window frame is provided with a separately removable screen secured to the frame in a position inside the swinging path of the sash. A regulating arm is arranged to pass through the window frame in order to effect the opening and closing operations of the window sash. A separate lock element is used to lock the regulating arm and thus the sash, in any preselected position relative to the window frame between completely closed and opened venting positions.

14 Claims, 6 Drawing Sheets

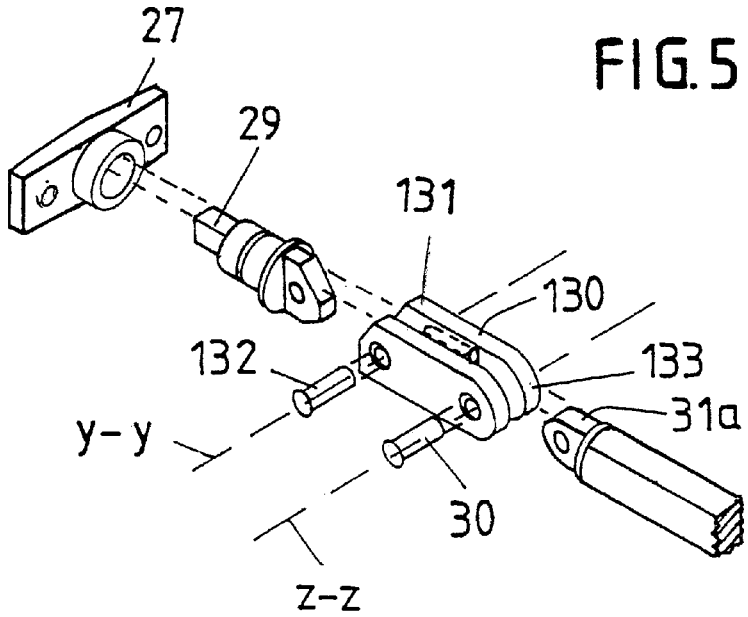
FIG. 5
FIG. 4
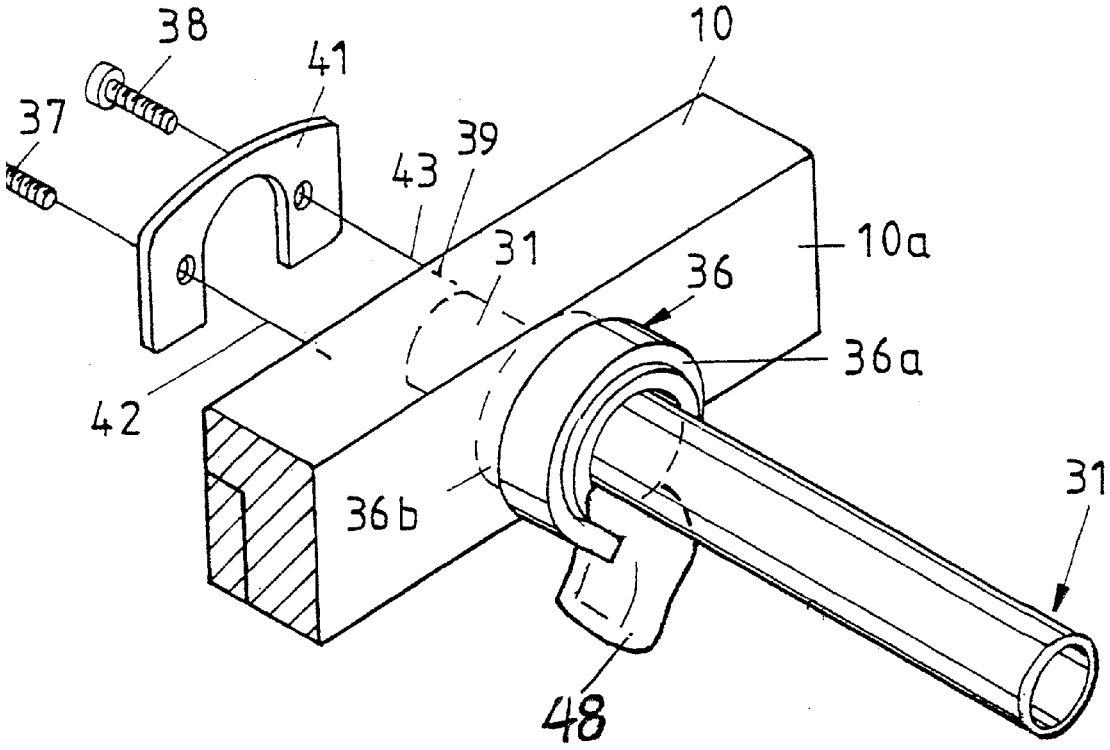

TURNABLE WINDOW ARRANGEMENT

This invention relates to a turnable window arrangement to be used together with a screen.

The term turnable window has been used to designate an arrangement of a window frame and a sash wherein the sash can be pivoted relative to the frame. Typically, the arrangement has a pair of support arm mechanisms secured to and between the frame and the sash with each mechanism having a pair of pivot arms to permit pivoting of the sash through a swing path of approximately 180°. The sash includes a pair of guide shoes mounted in opposite sides of the sash and a pair of corresponding grooves are provided in opposite sides of the frame to slidably receive the respective guide shoe of the sash during swinging.

Screens have also been known for use with not only turnable windows but also with swing type windows which allow a window sash to operate between opened and closed positions. In the case of a turnable window arrangement, the screen can be located at a position outside the sash to allow the window to be opened and closed from inside the screen. The disadvantage of this embodiment is that the screen must be designed in a box-like construction in order to allow the window sash to move outwardly to its fully opened position. Such box-like constructions may, however, be subjected to unfavorable atmospheric conditions, such as moisture, rain, snow, ice and wind in combination with moisture. Such box-like constructions also influence the aesthetic appearance of the house or building using the screens. Because of these features , it is preferred to locate the screen inside the window sash to shield the screen construction from atmospheric interactions, at least in the closed and venting window positions.

An embodiment wherein the screen is placed inside the window sash is disclosed in applicant's U.S. Pat. No. 4,860,811. This patent describes a turnable window construction provided with a separately removable screen secured to a frame in a position inside the swinging path of the sash. As described, a link arm mechanism is arranged to lock the sash in positions between completely closed and opened venting position. The link arm mechanism includes a socket member connected to the sash, a short support arm which passes through the frame to fit into the socket member at one end, and a regulating arm which is articulated to the opposite end of the support arm to pivot about an axis extending laterally of the support arm.

Further, the support arm is arranged to pass through a locking means in the frame which, upon release, allows unobstructed movement of the link arm mechanism.

The support arm is also rotatable in the socket member about an axis extending axially of the support arm to allow pivoting of the regulating arm from a locking position to an unlocked position, and vice versa, at the inward facing side of the frame, and also to allow a minor pivoting between the support arm and the regulating arm when moving the window sash into different venting positions.

In the embodiment disclosed in the U.S. patent, the regulating arm is provided with a number of arresting means extending laterally of the arm for cooperation with an adjustable locking pin in the locking means. Further, the arm is a telescopic arm mechanism with an inner arm inserted in a hollow outer arm and being lockable in longitudinally spaced positions therein. Further, the whole length of the regulating arm including an outer manipulating head portion has a cross section matching with the cross section of the passage in the lock member.

There is a disadvantage with this construction in that the window sash cannot be safely locked in any venting position, but may only be positioned in a restricted number of venting positions as mentioned above.

Thus, it is an object of the present invention to provide an improved turnable window arrangement in which a sash may be arrested in any fixed and preselected venting positions.

It is also another object of the present invention to provide a relatively simple locking means for locking a sash in place in a turnable window arrangement.

Briefly, the invention relates to a turnable window arrangement comprising a window frame having a passage therein, a sash, a pair of support arm mechanisms secured to the frame and the sash with each mechanism having a pair of pivot arms to permit pivoting of the sash relative to the frame and a socket member connected to the sash. In addition, a regulating arm is provided for passage through the passage in the frame into operative connection with the socket in the sash to pivot the sash between a fully opened venting position and a closed position relative to the frame.

In accordance with the invention, a locking means is mounted on the frame to releasably lock the regulating arm in any position from and between the fully opened venting position and the closed position. That is to say, the regulating arm may be locked relative to the frame in order to lock the sash in any one of a plurality of infinite positions between the fully opened venting position and the closed position of the sash. This locking means includes a sleeve which is inserted in the passage in the frame for slidably receiving the regulating arm and a clamping means within the sleeve to selectively grip the regulating arm.

In one embodiment, the clamping means is an elastic O-ring disposed about the regulating arm. In this embodiment, the locking means includes a manually rotatable lock element in the sleeve for distorting the O-ring radially inwardly to grip the regulating arm in response to rotation of the lock element. In this respect, the sleeve includes an internal seat which receives the O-ring as well as interior threads while the lock element has exterior threads threadably engaging the interior threads of the sleeve. Rotation of the lock element causes the lock element to abut and compress the O-ring against the internal seat of the sleeve thereby, in part, radially constricting the O-ring inwardly against the regulating arm.

In order to facilitate rotation, the lock element has a radially outwardly extending flap or handle for manual gripping thereof.

In another embodiment, the regulating arm includes an inner arm member and an outer arm member telescopically mounted on and over the inner arm member. In this embodiment, the regulating arm further includes a stop mechanism to lock the outer arm member in a selected position relative to the inner arm member. The stop mechanism includes a longitudinal bar member which is telescopically received in the outer arm member as well as a locking element threadably mounted on one end of the bar member and received in the inner arm member. This locking element includes a plurality of radially outwardly movable flaps, for example formed by longitudinal slots in the locking element. These flaps serve to engage the inner arm member in response to threading of the bar member into the locking element.

In order to prevent rotation of the locking element relative to the inner arm member, the inner arm member has an internal longitudinal ridge while the locking element has a longitudinal groove slidably receiving the ridge.

In another embodiment, the outer arm member of the regulating arm may be omitted.

In either embodiment of the regulating arm, a knob is secured to the end of the longitudinal bar member for rotating the bar member relative to the inner arm member.

These and other objects and advantages of the invention will become more apparent from the following description taken in conjunction with the accompanying drawings wherein:

FIG. 4 is a side perspective view of parts of a window frame and the locking means fixed to the frame;

FIG. 5 is an exploded view a hinge element mechanism employed with a regulating arm in accordance with the invention;

Figure 1:
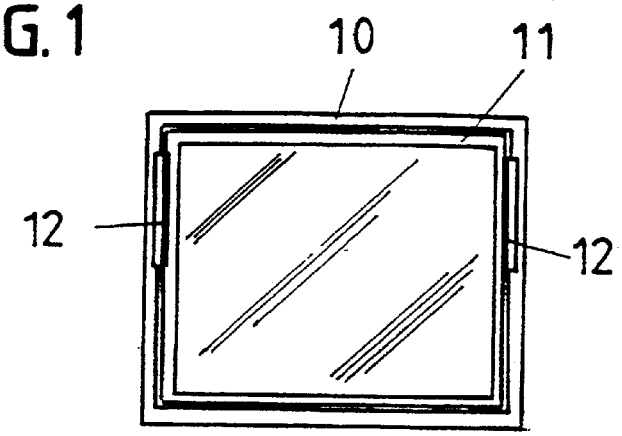
FIG. 1 is a front view of a turnable window as shown in closed position.
Figure 2:
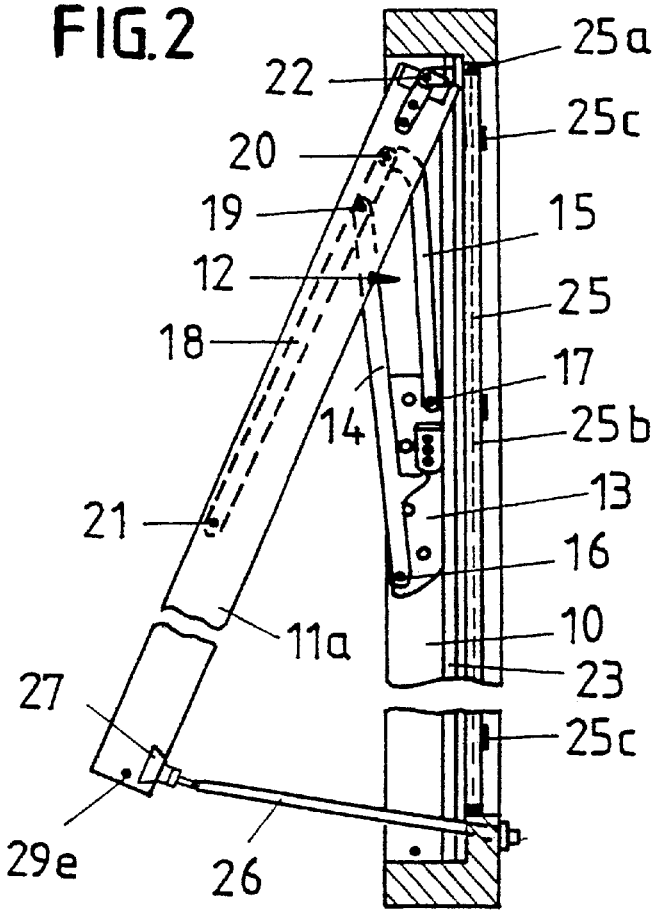
FIG. 2 is a section of the turnable window with the window sash tilted in a venting position.

Referring to FIGS. 1 and 2, the turnable window comprises a window frame 10 and a window sash 11, both preferably made of wood. However, in practice the frame and the sash may alternatively be made of other materials such as aluminum profiles or aluminum profiles covered with wood panels, and the like.

The turnable window also includes a pair of support arm mechanisms 12, one at each side of the window, for pivotally supporting the window sash 11 in the window frame 10. Each of the mechanisms 12 comprises a bracket member 13 secured to the window frame 10, a lower pivot arm 14 and an upper pivot arm 15 which are linked to the bracket member 13 via respective link pins 16 and 17 together with a third pivot arm 18 which is linked to the outer ends of the pivot arm 14, 15 via respective link pins 19 and 20. The pivot arm 14 and the pivot arm 18 are thus pivotally mounted about a common pivot axis defined by the pin 19. The pivot arm 18 is linked at the opposite end to a link pin 21 to the mid-portion of the window sash 11. A pair of guide shoes 22 arc pivotally mounted on opposite sides of the window sash 11 at the normally upper edge of the window frame 10. Each guide shoe 22 is slidably mounted in a groove 23 which runs over the height of the frame 10. On pivoting of the arms 14, 15 about the link pins 16, 17 of bracket member 13 and the pivoting of the arm 18 correspondingly about the link pins 19, 20 of the arms 14, 15 , the window sash 11 can be swung in an arcuate path in a conventionally-known manner about 180°, while the guide shoes 22 are displaced from the upper to the lower end of the grooves 23. This swing movement can be controlled by exerting a pushing force against the lower and upper edge portions of the window sash 11 respectively.

As shown in FIG. 2, a screen 25 is secured to the window frame 10. The screen 25 comprises a rigid circumferential frame 25*a* supporting a wire meeting, textile cloth 25*b* or similar filter material. By means of clips 25*c* or similar fastening means, the screen 25 may be secured to the window frame 10 in an easily detachable manner.

The window sash 11 is illustrated in FIG. 2 in a partially opened venting position which is achieved via the use of a regulating arm mechanism 26 with the screen 25 in its active filtering position.

Figure 3:
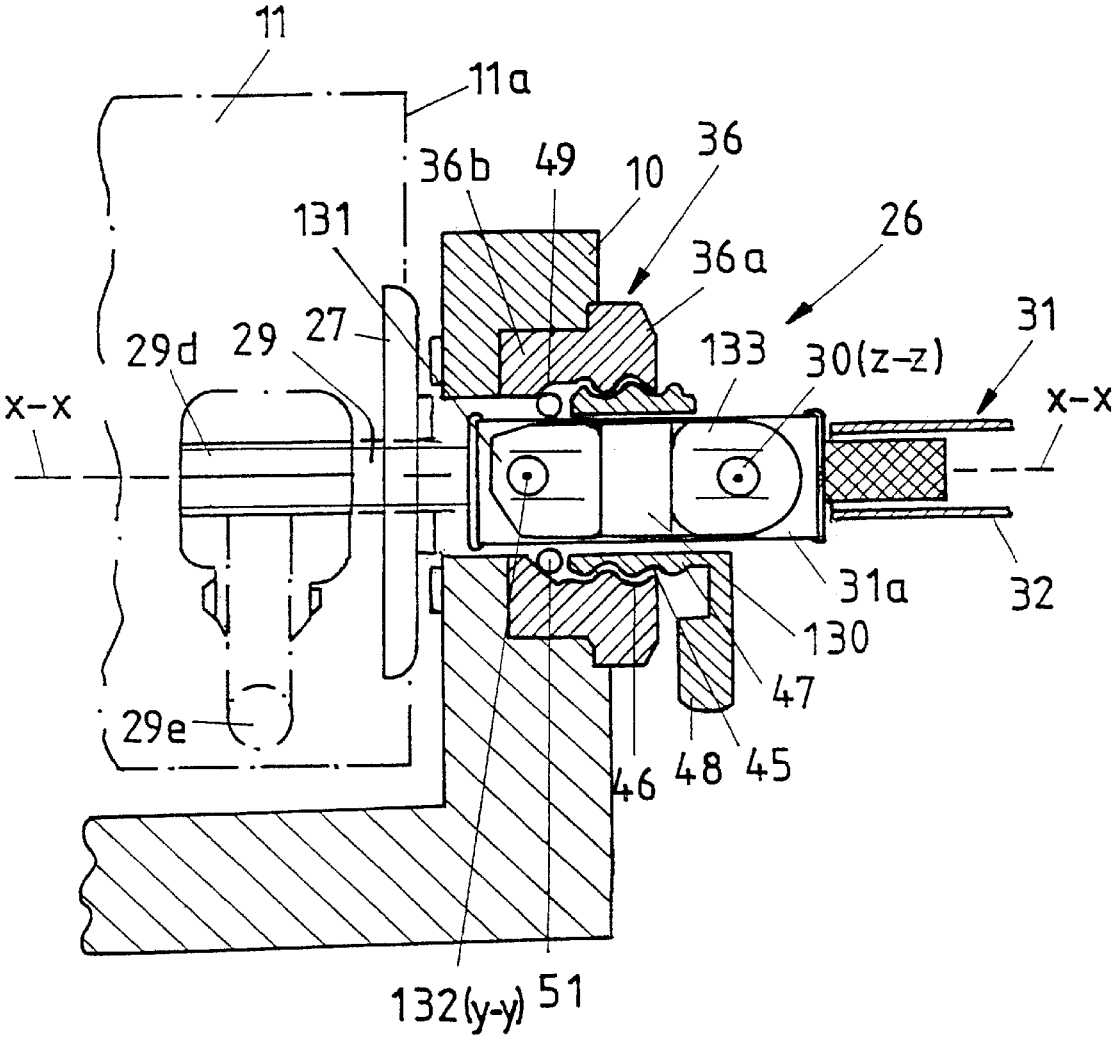
FIG. 3 is a cross-sectional view of a locking means in accordance with the invention with the window sash in a closed window position.

Referring to FIGS. 3 and 5, the regulating arm mechanism 26 comprises a socket member 27 secured by means of screws (not shown) to the sash inner surface 11*a* (FIG. 3), that is normally facing inwards in adjacent room as well as a support arm 29, hinge element 130 and regulating arm 31. The support arm 29 extends through and outwards of the socket member 27 and is pivotable in the socket member 27 about a central longitudinal axis x—x of the support arm 29. The tap formed hinge element 130 is articulated between the support arm 29 and an inner end 31*a* of the regulating arm 31. One end 131 of the hinge element 130 is connected to the support arm 29 via a first pivot pin 132, while the opposite end 133 of the hinge element 130 is connected to the arm end 31*a* via a second pivot pin 30. The opposite pivot pins 132, 30 of the hinge element 130 are arranged with their pivot axes y—y and z—z in parallel to each other, respectively, and crossing the longitudinal axis x—x of the support arm 29. As appears more clearly in FIG. 5, both end portions 131, 132 of the hinge element 130 are of fork-shaped design to receive the support arm 29 respectively, and have the pivot pins 30, 133 passing therethrough. Thus, the regulating arm 31 is pivotable about the two axes y—y and z—z relative to the support arm 29.

The inner end 31*a* of the regulating arm 31 may pivot more than 180° about the pivot axis z—z. The hinge element 130 is only pivotable to a minor extent, preferably about 30°, about the pivot axis y—y, and this minor extent is effected by the hinge having lugs preventing the free pivot movement.

Figure 8:
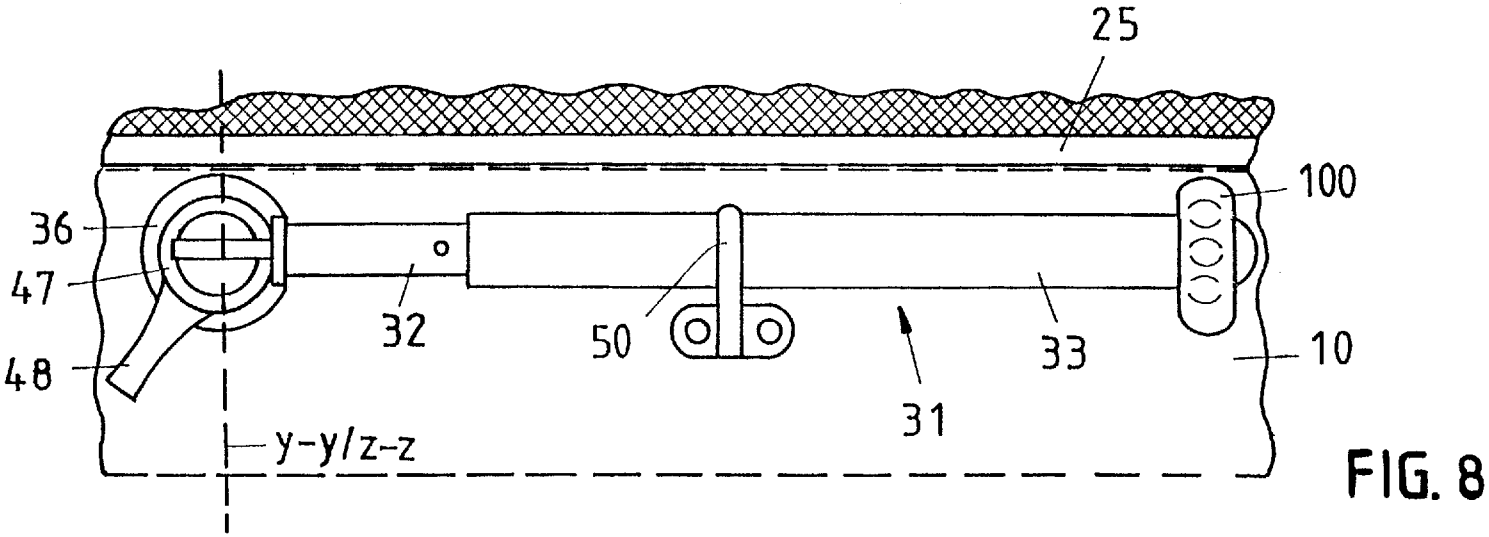
FIG. 8 is a part front view of the turnable window with the regulating arm in a stored position.
Figure 9:
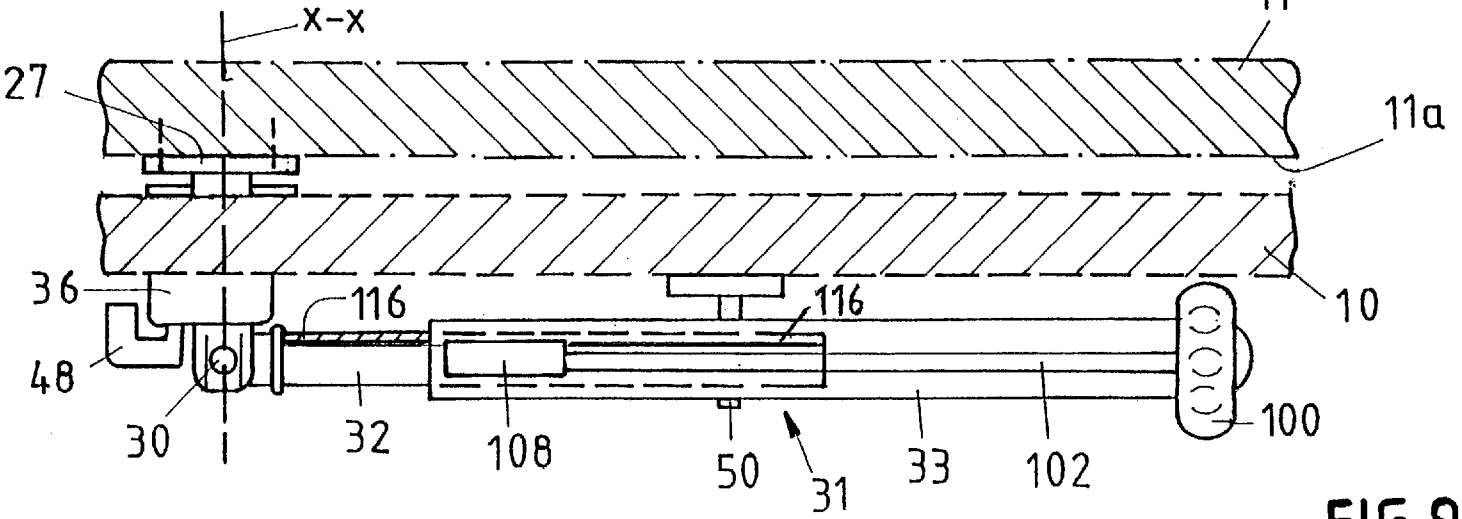
FIG. 9 is a top view of the turnable window and regulating arm of FIG. 8.

Referring to FIG. 3, a head member 29*d* of the support arm 29 protrudes through the socket member 27 and into a lower internal section of the window sash 11. The head member 29*d* is arranged to cooperate with an ordinary locking mechanism as indicated in broken and dotted lines in FIG. 3. By turning the support arm 29 at about an angle of 90° about the axis x—x, the head member 29*d* is arranged to push two cooperating locking pins 29*c* (only one pin is illustrated—see FIGS. 2 and 3) in opposite directions from a retracted inactive position in the window sash 11 into corresponding locking grooves in the window frame 10, and in a reverse direction from the locking position to the retracted inactive position, respectively. In a position as illustrated in FIGS. 3, 8 and 9, the window sash 11 is illustrated in its closed position with the head member 29*d* in a position corresponding to the active locking position of the locking pins.

As shown in FIGS. 6, 7, 8 and 9, the regulating arm 31 comprises an inner pipe-shaped, i.e. hollow, arm member 32 and an outer pipe-shaped arm member 33. The outer arm member 33 is designed to telescopically slide over the inner arm member 32.

Figure 6:
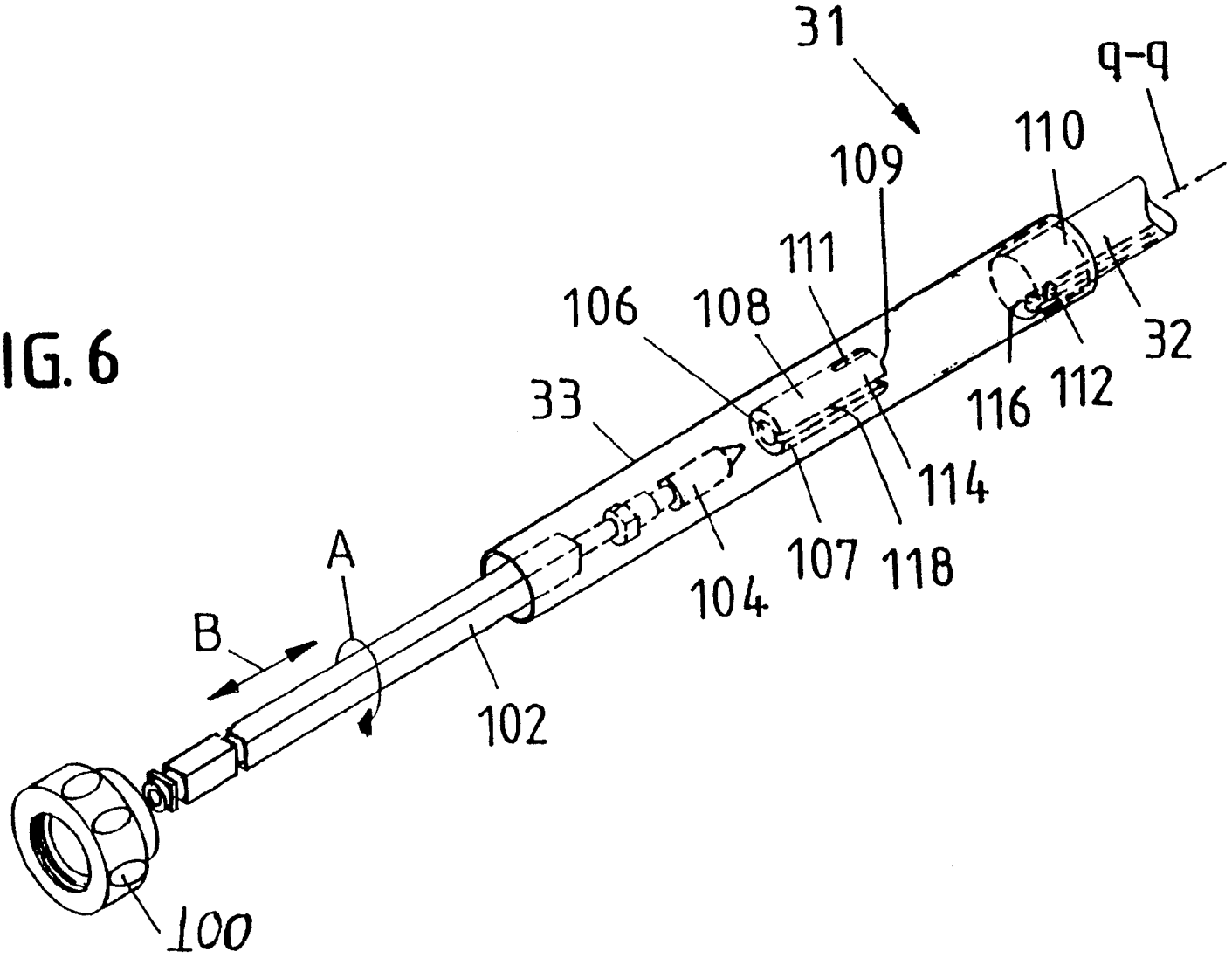
FIG. 6 is an exploded view of a regulating arm.

The outer arm member 33 includes a stop mechanism in order to lock and fix the outer arm member 33 in any preselected position in relation to the inner arm member 32. One preferred embodiment of this stop mechanism is shown in FIG. 6, and in addition reference is made to FIG. 9. The stop mechanism includes a longitudinal bar member 102 telescopically received in the outer arm member 33 and a locking element 108 threadably mounted on one end of the bar member and received in the inner arm member 32.

Referring to FIG. 6, the outer arm member 33 slidably receives the longitudinal bar member 102 while a knob 100 is removably connected to both the arm member 33 and the bar member 102 to form a rotatable unit. The bar member 102 extends parallel to axis q—q, and centrally into (through) the arm member 33. In FIG. 6 the three elements are partly dismantled to more clearly show the construction. As shown, the bar member 102 is partly pulled out of the arm member 33. When the arm members 32 and 33 are mounted together, the outer member 33 slides over the inner member 32, while the bar member 102 slides inside the inner member 32 (see FIG. 9). As shown in FIG. 6, the outer arm member 33 has an inwardly directed circumferential flange 110 while the inner arm member 32 has a stop lug 112 on the outside of the outer end portion. When the outer member 33 is telescopically retracted out of the inner member 32, the flange 110 engages the stop lug 112 and prevents the members 32, 33 from being separated.

The longitudinal bar member 102 carries a separate element 104 at the leading end which may be separately mounted on the bar member 102. This element 104 is provided with external threads corresponding to interior threads of a centrally formed bore 106 in a first end of the cylindrical locking element 108 disposed in the inner arm member 32. The bore 106 extends through the locking element 108, but tapers towards the second end 109 of the element 108 into a portion of the element 108 without internal threads. This portion of the locking element 108 includes axially grooves 111 which extend in parallel with the main axis q—q of the member 108, thus forming two or more flaps 114.

The bar member 102 with the threaded element 104 may be screwed into the bore 106 in the first end of lock member 108. When the leading end of the threaded element 104 enters into the narrower portion of the bore 106, the flaps 114 are pushed radially outwards. When this screwing operation is effected with the element 108 positioned inside the hollow inner arm 32, the flaps 114 are gradually moved radially outward to engage the inside wall area of the inner arm member 32 (see FIG. 9). Thus, the locking element 108 acts as an expansion lock element. In this situation, the expansion locking element 108 must be prevented from turning about the q—q axis. To obtain this function, the inner wall of the arm member 32 includes a longitudinal ridge 116 along its entire length. This ridge is parallel to the q—q axis. The locking element 108 comprises a correspondingly designed longitudinal groove 118 which is cut out in the outside wall.

When moving the members 32, 33 telescopically relative to each other, the expansion locking element 108 at the end of the bar member 102 slides along the ridge 116 via the groove 118. Thus, when the outer arm member 33 is turned relative to the inner arm member 33, for example clockwise as shown with arrow A in FIG. 6, the locking element 108 is prevented from turning, and the leading end of the threaded member 104 on bar member 102 pushes the flaps 114 radially outwards thus engaging the inner wall of inner arm member 32. Thus, the arm members 32, 33 may be locked in any fixed interrelated position.

The manner in which all the elements are interconnected in the mounted position, is illustrated in FIG. 9. Further, the connection of the inner end 31 a of the arm member 32 to the hinge element 29 appears in FIG. 5.

Since the function of the stop mechanism relies on the rotation of the bar member 102 itself, the outer arm member 33 has actually no locking functions and may, in accordance with another embodiment, be removed. Then the user operates the bar member itself entering the inner arm member 32, to effect the locking. In this embodiment, the bar member 102 and the inner arm member 32 must be equipped with cooperating stop members to prevent the elements from being separated.

The above-mentioned stop mechanism is important in order for the window sash to be arrested/fixed in any venting position by the operation of the locking element 108.

In order to obtain a locking effect between the telescoping hollow arm members 32, 33, a modified mechanism, as disclosed in U.S. Pat. No. 4,860,811 may also be used. The knob 100 may be replaced by a push button at the head of the regulating arm 33 for manually releasing a spring loaded stop means at the inner free end of the arm member, this spring member being designed to engage the inner surface of the inner arm member 32 in any preselected positions.

A locking means for the regulating arm 31 is secured at the surface 10*a* of the window frame 10 facing the adjacent room. FIGS. 3 and 4 illustrate how the locking means is mounted to the frame 10, and also the inner end 31*a* of the regulating arm 31 is shown. The locking means having a sleeve design is inserted partly in a correspondingly designed counterbored passage 39 through the frame 10.

The locking means includes a cylindrical sleeve 36 having an outer portion 36*a* of a given greater outer diameter and an inner portion 36*b* of a smaller outer diameter. A portion of the passage 39 through the frame 10 has a length corresponding to the length of the sleeve inner portion 36*b*. Thus, the sleeve inner portion 36*b* is inserted into the passage 39 and is fixed by means of screws 37, 38 entered through holes in a bracket 41 from the frame rear side, and they are screwed into the rear side of the sleeve 36, this being indicative by lines 42, 43 in FIG. 4.

The outer portion 36*a* of the sleeve 36 has interior threads 46 corresponding to exterior threads 45 of a sleeve formed lock element 47 of the locking means. Further, the lock element 47 comprises a radially outwardly extending flap 48 for gripping by an operator's fingers. At the bottom of the interior threaded portion of the sleeve 36, the thread portion ends and the sleeve bore continues with a smaller diameter, thus forming a seat 49 prepared for positioning of a clamping means in the form of a compressible elastic O-ring 51, preferably made of rubber. Further, when the lock element 47 is screwed into the sleeve 36, for example effected by an operator gripping the flap 48 between his fingers, the O-ring 51 will be squeezed, and will distort at least inwardly in a radial direction. The regulating arm 31 passing through the bore of the lock element 47 will then be clamped to an arrested or fixed position by the radially inwardly constricted O-ring 51.

In order to move the window sash 11, the lock element 47 is manually pivoted in a direction to loosen the grip of the O-ring 51 around the regulating arm 31. The regulating arm 31 can then be slid through the sleeve 36 to move the sash 11 to any convenient position with the sleeve 36 being used as a guide. When the window sash 11 has come to its correct position, the element 47 is turned to squeeze the O-ring 51 against the regulating arm 31, thus fixing the window sash in this position.

Different positions of the regulating arm 31, and for operating the opening and closing of the window, are shown in FIGS. 3, 7, 8 and 9.

According to FIG. 3, the regulating arm 31 is positioned mainly parallel to the central longitudinal axis x—x. In this position, the different venting positions of the window may be selected by pulling the arm 31 through the sleeve 36.

The cross-section of the passage 39 in the window frame 10 is somewhat greater than the cross-section of an arm 31 and hinge element 130. In a closed window position, an air seal is formed by the O-ring 51 clamping against the surface of the regulating arm 31. To obtain extra air sealing, it is also possible to provide a weather strip (not shown) at the rear side of the frame 10 which strip will engage the inner surface of the window sash 11 in its closed position.

The steps involved to move the window sash 11 from its opened venting position according to FIG. 2 to its closed position are illustrated in FIGS. 3 and 7 to 9.

By loosening the locking means via the lock element 47, the operator may pull on the regulating arm 31 (position shown in FIG. 2) in order to slide the arm 31 through the passage 39. The hinge element 130 extends through the passage 39 in the frame 10 and partly into the room, the arm 31 being parallel with the axis x—x. This position is shown in FIG. 3.

Figure 7:
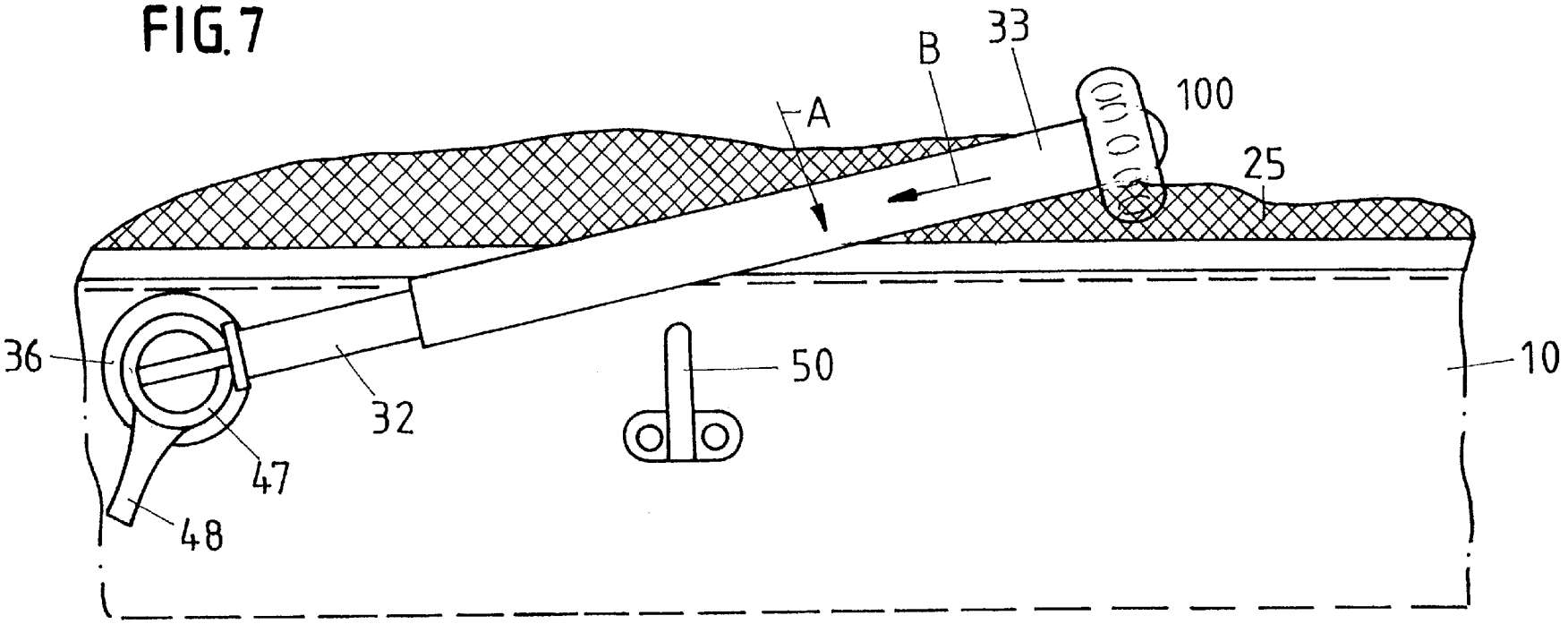
FIG. 7 is a front view of the regulating arm of FIG. 2 in a released, partly pivoted and partly telescopically extending position.

Now the regulating arm 31 is pivoted upwards about the pivot axis z—z by an angle 90°, and is then, as indicated by the arrow A in FIG. 7, turned downwardly to its intermediate position, where the regulating arm 31 is arranged in an angular position sidewise of the axis x—x along the window frame 10 inner surface, i.e. along the surface facing inwards in the adjacent room. Now, the internal expansion locking element 108 inside the arm member 32 is released by turning the arm member 33 about its longitudinal axis, and the arm member 33 is pushed (from the telescopically extended position), over the arm member 32 as indicated by the arrow B in FIG. 7 to a collapsed position. Again, the internal expansion locking element 108 inside the arm member 32 is activated by turning the outer arm member 33 relative to the inner arm member 32.

The above-mentioned swing operation also moves the head member 29*d* of the support arm 29 into the locking mechanism in the sash 11 as disclosed above.

The regulating arm 31 is further pivoted into a horizontal position (FIG. 8) and brought to rest in a support bracket 50 which is fastened to the inner face of the frame 10. Then, the lock member 47 may be turned to fix the sash 11 (or more correctly the hinge element 130) in a closed position, by means of the radial inwardly constricted O-ring 51 gripping the hinge element 130.

In order to move the window sash 11 from its closed position (FIGS. 3 and 7 to 9) to an opened venting position (FIG. 2), the above-mentioned steps may be carried out in the reverse order.

When the window sash 11 is pushed to its fully opened position, the telescoping regulating arm 31 is pulled out to its longest extent and is clamped at one end by the O-ring 51. In this position, the locking element 108 remains within the inner arm member 32. In this situation, it is necessary to activate the expansion locking element 108 to fix the arm members 32, 33 to each other, otherwise one risks that the window will rattle when it is subjected to the wind since the inner arm member 32 is partly freely movable relative to the outer arm member 33.

Since the window sash must be allowed to turn approximately 180° into the position with the normally outer window surface facing inwards to the adjacent room, it is possible to push the arm 31 further through and axially out of the passage 39 in the frame 11 after having removed the knob 100. This can be done in any conventional manner. Thus, it is possible to easily clean the outer window sash surface from the adjacent room.

What is claimed is:

1. A turntable window arrangement comprising a window frame having a passage therein;

a sash;

a socket member connected to said sash;

a pair of support arm mechanisms secured to said frame and said sash, each mechanism having a pair of pivot arms to permit pivoting of said sash relative to said frame;

a regulating arm fur passage through said passage in said frame into operative connection with said socket member on said sash, said regulating arm being movable axially through said passage in said frame to pivot said sash between a fully open venting position and a closed position relative to said frame; and a locking means mounted on said frame to releasably lock said regulating arm relative to said frame to lock said sash in any one of a plurality of infinite positions between said fully open venting position and said closed position.

2. A turnable window arrangement as set forth in claim 1 wherein said locking means includes a sleeve inserted in said passage of said frame and slidably receiving said regulating arm and a clamping means within said sleeve to selectively grip said regulating arm.

3. A turnable window arrangement as set forth in claim 2 wherein said clamping means is an elastic O-ring disposed about said regulating arm and said locking means includes a manually rotatable lock element in said sleeve for distorting said O-ring radially inwardly to grip said regulating arm in response to rotation of said lock element.

4. A turnable window arrangement as set forth in claim 3 wherein said sleeve includes an internal seat receiving said O-ring and interior threads and said lock element has exterior threads threadably engaging said interior threads of said sleeve.

5. A turnable window arrangement as set forth in claim 3 wherein said lock element has a radially outwardly extending flap for manual gripping thereof.

6. A turnable window arrangement as set forth in claim 1 wherein said regulating arm includes an inner arm member and an outer arm member telescopically mounted on and over said inner arm mechanism.

7. A turnable window arrangement as set forth in claim 6 wherein said regulating arm further includes a stop mechanism to lock said outer arm member in a selected position relative to said inner arm member.

8. A turnable window arrangement as set forth in claim 7 wherein stop mechanism includes a longitudinal bar member telescopically received in said outer arm member and a locking element threadably mounted on one end of said bar member, and received in said inner arm member, said locking element having a plurality of radially outwardly movable flaps for engaging said inner arm member in response to threading of said bar member into said locking element.

9. A turnable window arrangement as set forth in claim 8 wherein said inner arm member has an internal longitudinal ridge and said locking element has a longitudinal groove slideably receiving said ridge to prevent rotation of said locking element relative to said inner arm member.

10. A turnable window arrangement as set forth in claim 1 wherein said regulating arm includes an inner arm member, a longitudinal bar member and a locking element threadably mounted on one end of said bar member, and received in said inner arm member, said locking element having a plurality of radially outwardly movable flaps for engaging said inner arm member in response to threading of said bar member into said locking element.

11. A turnable window arrangement as set forth in claim 10 wherein said inner arm member is hollow and has an internal longitudinal ridge and said locking element has a longitudinal groove slidably receiving said ridge to prevent rotation of said locking element relative to said inner arm member.

12. A turnable window arrangement as set forth in claim 10 which further comprises a knob secured to an end of said longitudinal bar member for rotating said bar member relative to said inner arm member.

13. A turnable window arrangement comprising a window frame having a passage therein;

a sash;

a socket member connected to said sash;

a pair of support arm mechanisms secured to said frame and said sash, each mechanism having a pair of pivot arms to permit pivoting of said sash relative to said frame;

a regulating arm for passage through said passage in said frame into operative connection with said socket member on said sash, said regulating arm being movable axially through said passage in said frame to pivot said sash between a fully open venting position and a closed position relative to said frame; and a locking means mounted on said frame to releasably lock said regulating arm in any position from and between said fully open venting position and said closed position, said locking means including a sleeve inserted in said passage of said frame and slidably receiving said regulating arm, an O-ring disposed within said sleeve about said regulating arm to selectively grip said regulating arm and a manually rotatable lock element in said sleeve for distorting said O-ring radially inwardly to grip said regulating arm in response to rotation of said lock element.

14. A turnable window arrangement comprising a window frame having a passage therein, a sash;

a socket member connected to said sash;

a pair of support arm mechanisms secured to said frame and said sash, each mechanism having a pair of pivot arms to permit pivoting of said sash relative to said frame;

a regulating arm for passage through said passage in said frame into operative connection with said socket in said sash, said regulating arm being movable axially through said passage in said frame to pivot said sash between a fully open venting position and a closed position relative to said frame; said regulating arm including a hollow arm member, a longitudinal bar member and a locking element threadably mounted on one end of said bar member and received in said inner arm member, said locking element having a plurality of radially outwardly movable flaps for engaging said inner arm member in response to threading of said bar member into said locking element and an internal longitudinal ridge; and a locking means mounted on said frame to releasably lock said regulating arm in any position from and between said fully open venting position and said closed position; said locking element having a longitudinal groove slidably receiving said ridge of said locking element to prevent rotation of said locking element relative to said inner arm member.

* * * * *